US005493484A

United States Patent [19]

Osteen et al.

[11] Patent Number: 5,493,484

[45] Date of Patent: Feb. 20, 1996

[54] PORTABLE FLOODLIGHT AND STAND

[75] Inventors: Mitchell O. Osteen, Zirconia; Suleyman O. Sumer, Chapel Hill; Charles L. Dozier, Camden, all of N.C.

[73] Assignee: Regent Lighting Corporation, Burlington, N.C.

[21] Appl. No.: 138,929

[22] Filed: Oct. 18, 1993

[51] Int. Cl.[6] ..... F21S 1/12

[52] U.S. Cl. ..... 362/410; 362/287; 362/375; 362/399; 362/427

[58] Field of Search ..... 362/376, 269, 362/285, 414, 287, 382, 399, 374, 410, 427, 455, 310, 375; 16/111 R, 114 R, 112

[56] References Cited

U.S. PATENT DOCUMENTS

| | | | |
|---|---|---|---|
| D. 316,456 | 4/1991 | DeCandia | D26/60 |
| 1,910,779 | 5/1933 | Stockman | 362/376 |
| 3,254,205 | 5/1966 | Cobb | 362/269 |
| 3,663,808 | 5/1972 | Baatz | 362/267 |
| 4,413,312 | 6/1983 | Morkosky | 362/269 |
| 4,489,368 | 12/1984 | Sangiamo et al. | 362/269 |
| 4,626,975 | 4/1986 | Miletich | 362/418 |
| 4,654,764 | 3/1987 | Hsiao | 362/287 |
| 4,760,508 | 7/1988 | Russello et al. | 362/285 |
| 4,760,511 | 1/1988 | Russello | 362/427 |
| 4,796,001 | 7/1989 | Gostyla | 338/20 |
| 5,195,823 | 3/1993 | Sidabras | 362/269 |
| 5,243,507 | 9/1993 | Atkins et al. | 362/310 |
| 5,307,255 | 4/1994 | Chen | 362/410 |

FOREIGN PATENT DOCUMENTS

| | | | |
|---|---|---|---|
| 603893 | 10/1934 | Germany | 362/376 |

*Primary Examiner*—Ira S. Lazarus
*Assistant Examiner*—Y. Quach

[57] ABSTRACT

A lamp housing is pivotally connected to a support stand having a top portion and a plurality of legs. A support boss extends upwardly from the top portion to which the housing is mounted. The electrical connections and components are mounted beneath the domed portion of the support stand.

31 Claims, 6 Drawing Sheets

PORTABLE FLOODLIGHT AND STAND

BACKGROUND AND SUMMARY OF THE INVENTION

The present invention is directed to portable floodlights and, more specifically, to an improved portable floodlight and stand therefor in which the conventional formed metal stand and splice box are relocated into a unique support stand. A unique swivel connection mounts the lamp housing to the stand.

Portable floodlights have become extremely popular in recent years. Such floodlights enable a consumer to extend the daylight activities with a portable source of light. Such floodlights are commonly provided with quartz lamps. Such floodlights have been found useful for recreational purposes such as camping, boating, entertaining, and sports such as volleyball and basketball; as a spotlight for decorating homes during holidays; for construction purposes such as painting, cleaning gutters, building decks, installing doors and windows, or pouring cement at night; or for emergency situations such as automotive problems, frozen pipes, and the like.

One type of portable floodlight presently available in the marketplace generally includes a formed metal or steel stand having a pair of parallel, horizontally extending legs which rest on some type of horizontal surface (floor, ground or the like). One of the legs continues upwardly and along a raised parallel horizontal path and has mounted thereto a lamp housing. A rather large handle is provided above the lamp housing for carrying the lamp from place to place. The lamp housing is generally pivotally mounted in some manner with a U-shaped bracket to the aforesaid horizontally extending support member of the stand.

A splice box or some other electrical enclosure containing a switch and electrical components is generally attached to the rear of the housing and provides a weatherproof outlet for the electrical components and/or connection. The lamp housing of conventional portable floodlights generally includes a peripheral flange which surrounds and frames a front opening. A glass lens is mounted in the rectangular open front and is usually sealed to the flange by a silicon rubber gasket for the purposes of making the housing watertight.

According to the present invention, various changes and modifications have been made to the conventional configuration in order to provide an improved product that also achieves certain manufacturing cost efficiencies. A first change that has been made is to eliminate the formed, generally S-shaped metal stand and replace it with a die-cast stand which is essentially a domed top with three downwardly and outwardly extending legs. The dome portion includes a stem extending upwardly therefrom to which the lamp housing is pivotally attached. The electronics or splice box is no longer attached to the rear of the lamp housing, however, has been moved to a position beneath the dome where it is protected from the weather and other elements. A supply cord connecting to the electrical components therein extends outwardly through the wall of the domed portion where connections can be made to a power source either directly or through an extension cord. In order to protect the electrical connections beneath the dome, a cover-plate is secured to the stand at a point beneath and spaced from the dome. In an alternate design for use with high pressure sodium lamps, a separate electrical component enclosure is used to mount such items as ballasts, starting aids, igniters, and the like to appropriate mounting bosses. This die-cast can replaces the cover-plate in such alternate embodiments, and permits the same fixture to be used with either double-ended high-pressure sodium lamps or quartz lamps.

The connection joint between the stand and the lamp housing includes a boss which extends upwardly from the domed portion of the stand and is received within an appropriate slot or opening in the bottom wall of the lamp housing. A connector clip is then mounted to the upper end of the stem. The connector clip is spring-biased against support surfaces within the housing to retain the housing in place. The spring-bias relationship between the clip and the housing provides adequate friction to hold the lamp housing at a selected position, yet allow it to be adjusted to another position without the use of tools, such as wrenches, pliers, or screwdrivers. The lamp housing, at its front opening, includes a forwardly extending protective flange or ledge extending around the sides, bottom and top. Two metal clips are used, one at the top and one at the bottom to hold the glass lens in place. A groove is provided in the casting around and beneath the periphery of the glass. The groove will channel any water that enters behind the glass to the bottom so that it can drain. Thus, the conventional silicon gasket is not necessary and has been eliminated. Instead of the traditional approach of keeping water out of the fixture housing by sealing it to be as rain-tight as possible, the present approach represents a new concept. In the new concept, the fixture head is so configured and the lens so loosely connected to the housing that any water which should enter the fixture also has a place to exit the fixture.

The handle for the fixture of the present invention is formed of a wire material formed into a generally U-shape. The ends of the wire snap into passageways in spaced mold seats behind the front flange along the top housing wall. In one position, the handle is folded down adjacent the housing to enable shipment in a minimum size box. Upon receipt of the product, the customer simply rotates the handle upwardly, whereupon it snaps into a locked position in the seats, all without tools.

It is therefore an object of the present invention to provide improvements in portable floodlights.

It is another object of the present invention to improve portable floodlights by replacing the conventional formed metal stand with a unique sturdier stand which is more economical to manufacture.

It is yet another object of the present invention to provide a portable fixture of the type described which includes a unique swivel mounting means for connecting the lamp housing to the support stand.

Still a further object of the present invention is to provide a portable floodlight of the type described in which the splice box, ballast, starting aid, and all electrical connections have been moved from the rear of the lamp housing and incorporated into the support stand.

Other objects and a fuller understanding of the invention will become apparent from a study of the following detailed description of a preferred embodiment along with the accompanying drawings in which.

DETAILED DESCRIPTION OF A PREFERRED EMBODIMENT

Figure 2:
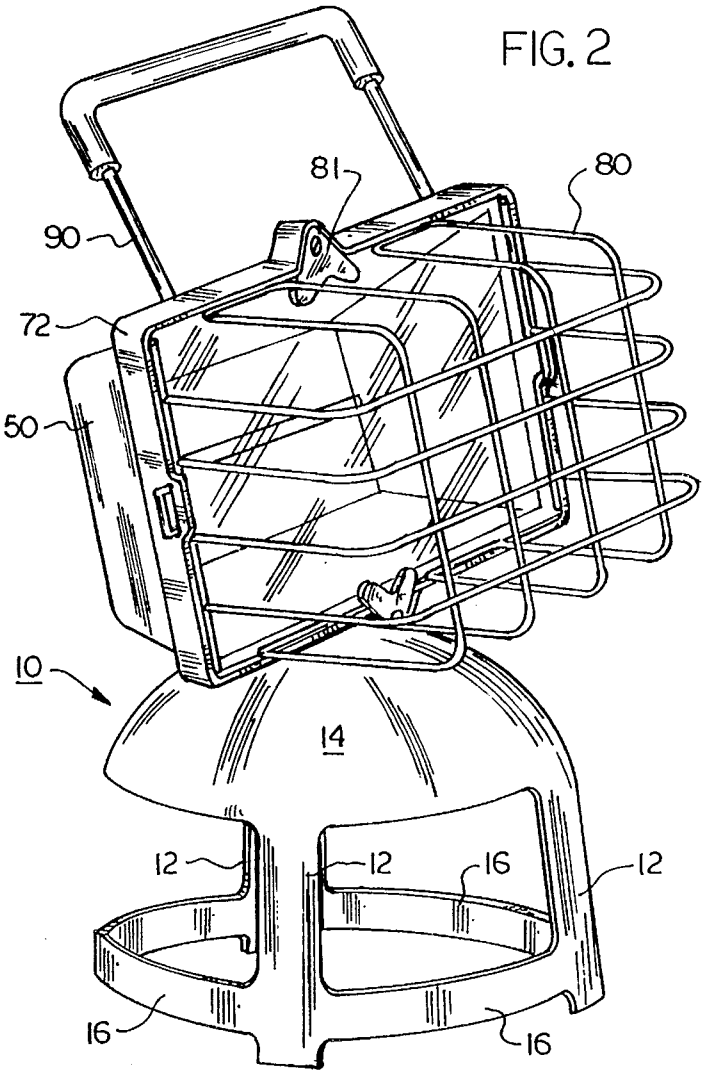
FIG. 2 is a perspective view of the portable floodlight and stand according to one embodiment of the present invention.
Figure 1:
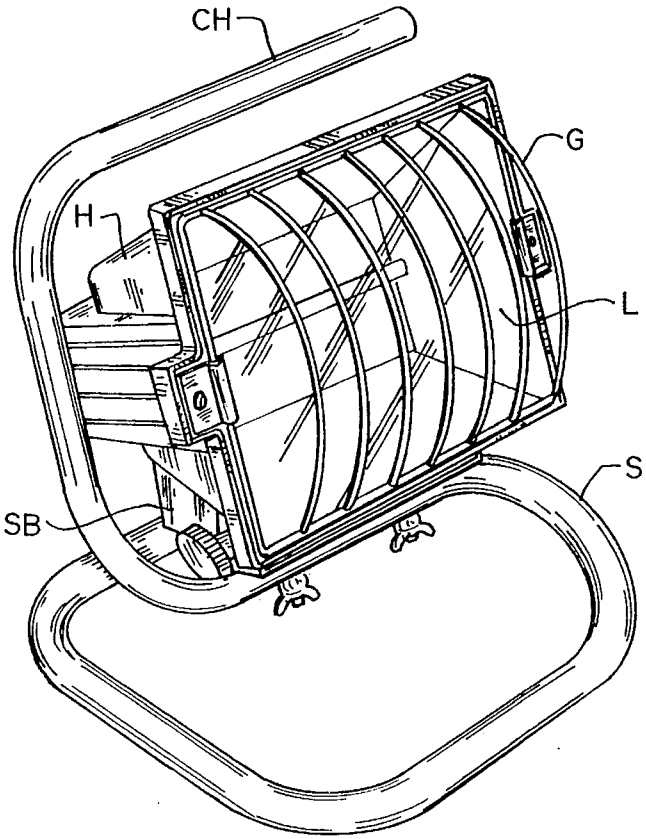
FIG. 1 PRIOR ART
FIG. 1 is a perspective view of a portable floodlight and stand as is presently commercially available.

Turning now to the drawings, and particularly to FIG. 1, there is illustrated a portable quartz floodlight of the type generally available in the prior art having a housing H with top, bottom, side and rear walls forming a substantially rectangular opening. The housing H contains a quartz lamp (or other type of lamp) therein, a reflector mounted within the housing, a support stand S on which the housing is mounted, a front lens L, a wire safety guard G, and a carrying handle CH.

The prior art stands generally comprise a pair of parallel feet upon which the stand is mounted. The stand curves upwardly and inwardly to form a horizontal lamp support to which a U-shaped bracket is attached. The lamp housing is then pivotally attached to the U-shaped bracket. The only place in this type of fixture for the mounting or provision of a switch, electrical connections, or a place for the incoming power line to be connected to the electrical components within the housing is by means of a splice box SB attached to the rear of the housing. This construction is relatively expensive and, since the stand generally rests on three horizontally disposed, elongated tubular members, it can be relatively unsteady if the support surface is not very flat.

Figure 6:
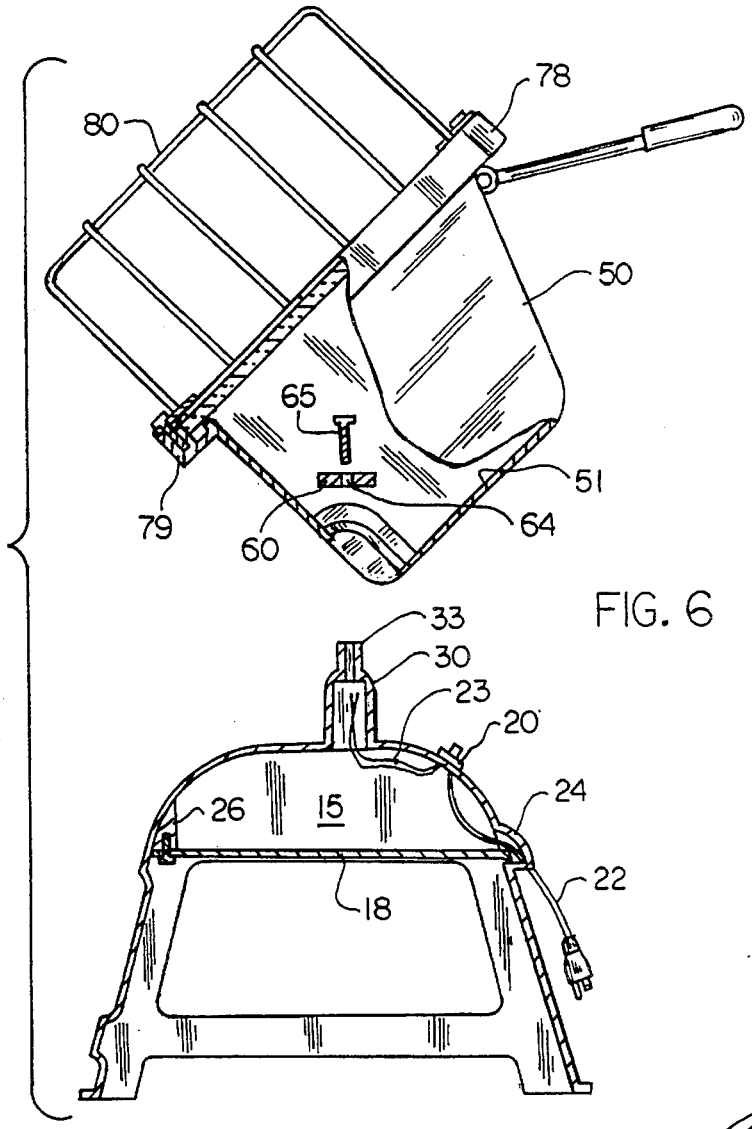
FIG. 6 is an exploded side view, partially in section, illustrating the housing and stand.

The floodlight and stand of the present invention is best illustrated in FIGS. 2–5. In this embodiment, a stand 10 is provided to which a lamp housing 50 is attached. Support stand 10 includes a plurality of legs 12 extending downwardly from a domed top 14. A plurality of arcuate support bars 16 connect and support the legs 12 adjacent the lower ends thereof. A cover-plate 18 (FIG. 6) is attached to the stand 10 at a point beneath and spaced from the bottom of the domed portion 14. The cover-plate 18 forms a protective chamber 15 in the domed portion which protects the wire from the lamp and the electrical terminals from water and the elements. A waterproof switch 20 is mounted appropriately in the dome 14 with its terminals extending interiorly of the domed portion (FIG. 6). Electrical power is provided to the unit through the supply cord 22 which enters the dome 14 through a hooded opening 24 in the side thereof. A plurality of attachment bosses 26 extend downwardly from the beneath the domed portion for attaching the cover-plate 18 as illustrated in FIG. 6 or for attaching the ballast enclosure as will be explained hereinafter.

A support boss 30 extends upwardly from the domed portion 14 and includes a rounded upper end from which a stem 32 extends upwardly into the lamp housing 50 as will be described hereinafter. The configuration of the support boss 30 is best illustrated in FIGS. 10–13 and includes a generally rectangular upstanding block having a rounded upper end 31 and a stem or seat 32 extending upwardly from the central portion thereof. The boss 30 and stem 32 include a central passageway 33 therein through which the wires 23 from switch 20 extend to the lamp thereabove. A pair of threaded wells 34,35 also extend downwardly into the upper end of stem 32 to receive fasteners as will be hereinafter described.

Figure 12:
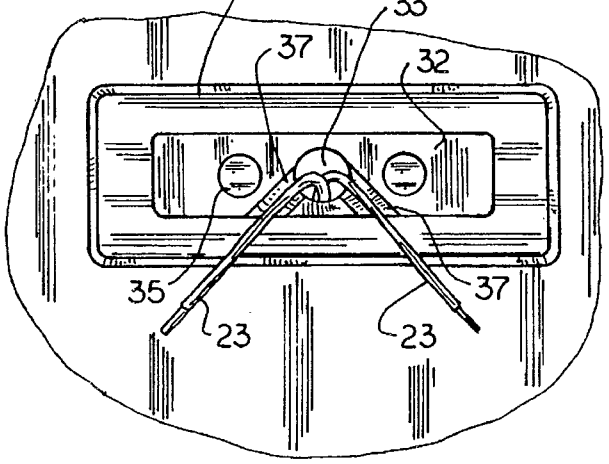
FIG. 12 is a top view of the support boss of FIG. 10 with the housing removed.

Looking at FIG. 12, there is shown a plan view of boss 30 and stem 32, a pair of angular passageways 37 each extends outwardly from the upper end of passageway 33. One of the wires 23 from switch 20 extend through each of the passageways 37 to route the wiring as required to position it away from the hot reflector 51.

Figure 11:
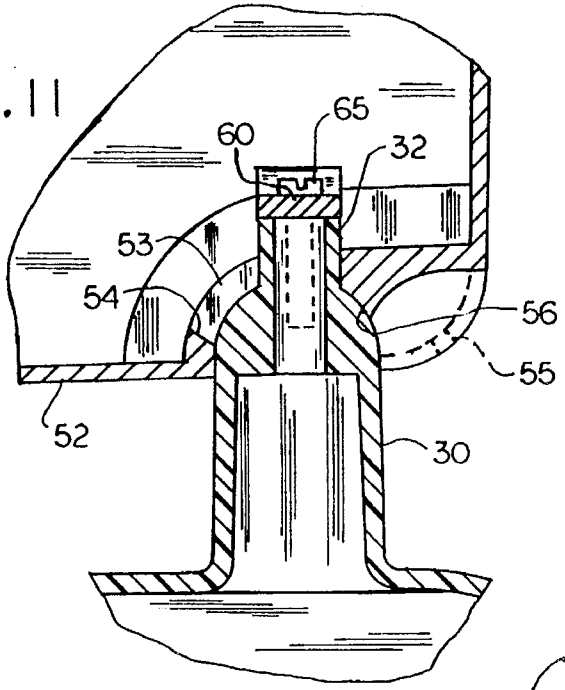
FIG. 11 is a sectional view of taken substantially along lines 11—11 in FIG. 13.
Figure 10:
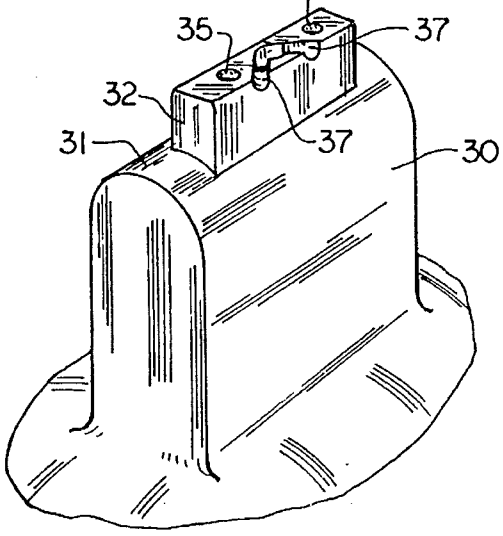
FIG. 10 is a perspective view of the support boss to which the lamp housing is mounted.
Figure 13:
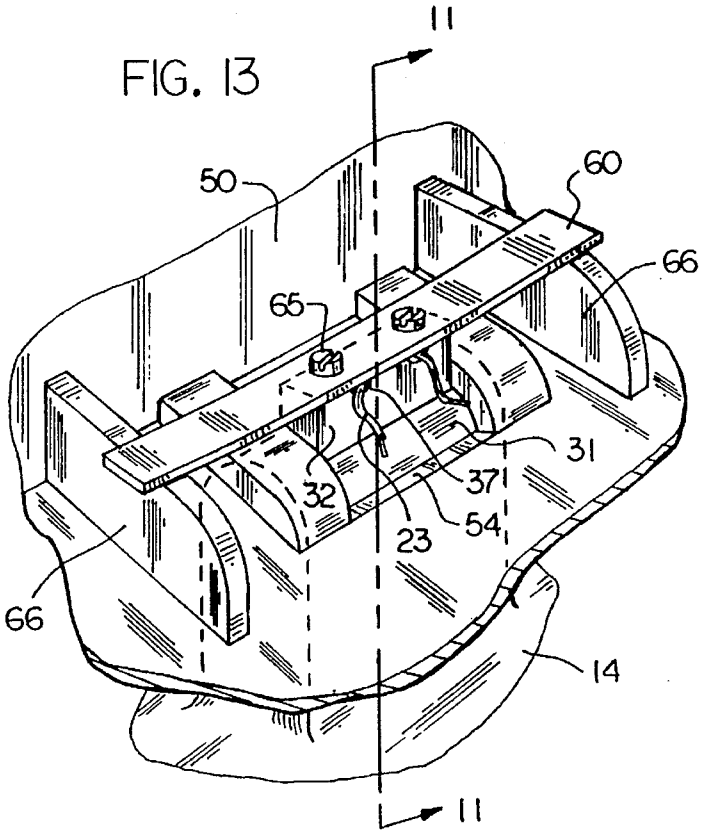
FIG. 13 is a perspective view similar to FIG. 10 except showing the housing mounted on the support boss.

Housing 50 includes top, bottom, side, and rear walls forming a substantially rectangular front opening. As best illustrated in FIGS. 11 and 13, the lower rear portion of housing 50 includes a laterally extending slot 53 or opening through which stem 32 extends. The lower wall 52 of housing 50 includes a central rear recessed portion having a curved or arcuate configuration which contains the previously mentioned slot 53. The curved configuration is so configured as to rest on and compatibly pivot about the rounded portion 31 of boss 30. A front stop 54 and rear stop 56 are provided in the lower wall of housing 50 adjacent to the slot 53 to limit the movement of housing 50 in its arcuate path. Toward this end, the housing will cease rotation once either front stop 54 or rear stop 56 engages the stem 32.

A retaining clip 60 is provided with a pair of openings 64 therein which correspond in size and spacing to align with the wells 34 in stem 32. A fastener 65 extends through each opening 64 in the clip 60 and into the threaded wells 34,35 for retaining the clip 60 thereon. When assembled, the ends of the clips 60 rest on the spaced clip support walls 66 of housing 50 and act as a spring (FIG. 13). The screws 65 are tightened to provide the desired pressure exerted by the clip 60 against support walls 66. So arranged, the housing may be rotated merely by moving the housing against the spring pressure to position the housing as desired on stem 32. The housing will remain in the desired position until moved to a further position.

Figure 4:
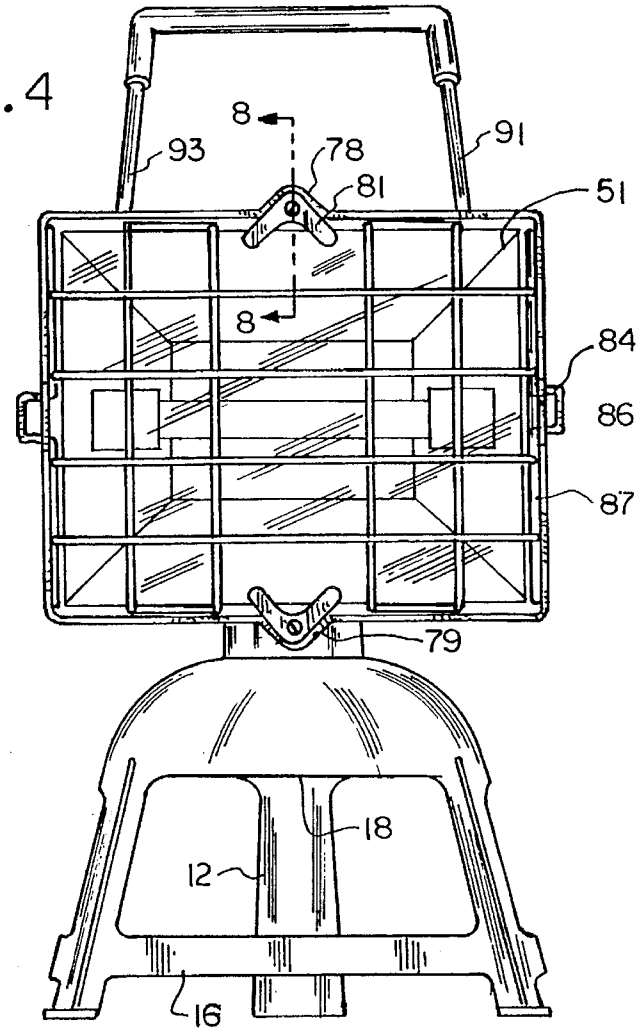
FIG. 4 is a front view of the floodlight and stand of FIG. 1.
Figure 3:
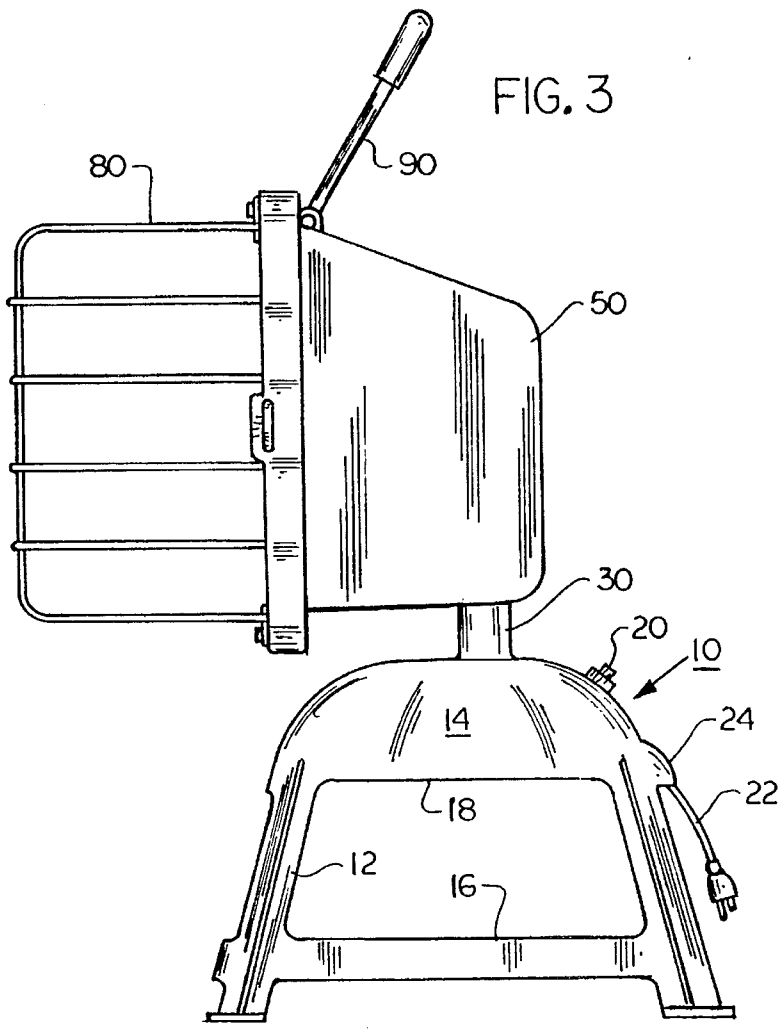
FIG. 3 is a side view of the floodlight and stand of FIG. 1.
Figure 5:
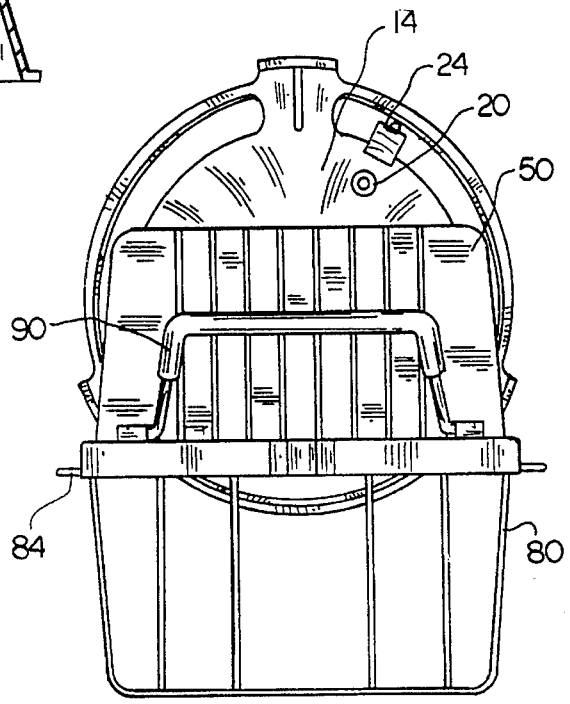
FIG. 5 is a top view of the floodlight and stand of FIG. 1.

As illustrated in FIGS. 3–5, a wire guard 80 is mounted to the front face of housing 50. One of the unique aspects of the present invention is that, when wire guard 80 is removed, it is of such a size and configuration as to allow housing 50 to rest therein. Therefore, the housing 50 and wire guard 80 nest together when disassembled for economies in shipping.

Figure 7:
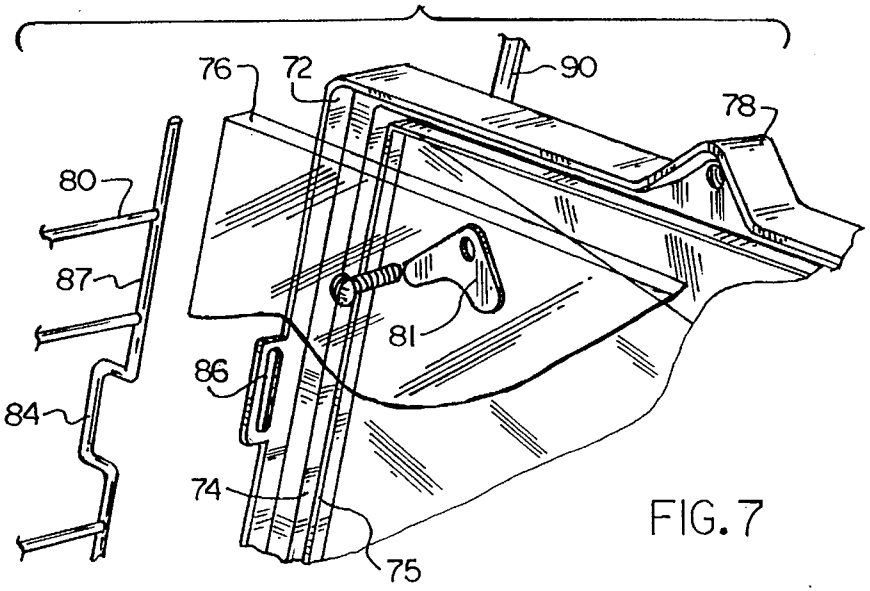
FIG. 7 is a perspective view of the upper corner of the lamp housing with parts broken away illustrating the relationship between the housing flange, the lens, and the wire guard.
Figure 8:
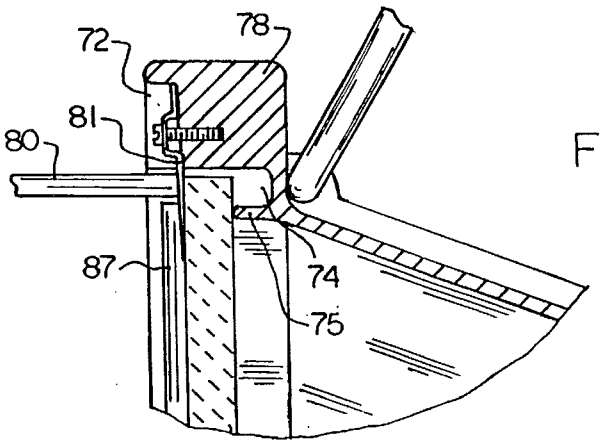
FIG. 8 is a sectional view taken substantially along lines 8—8 in FIG. 4.

As best illustrated in FIGS. 7 and 8, housing 50 includes a front flange 72 having a peripheral recessed groove 74 extending therearound adjacent the inner portion thereof. As best shown in FIG. 8, recessed groove 74 is formed between the outer wall portion of flange 72 and the forwardly extending inner rim 75, which is generally an extension of the upper and lower wall of housing 50. A flat glass lens 76 is placed within the flange 72 and rests against the rim 75.

With reference to FIG. 4, flange 72 also includes upper and lower protrusions 78,79 respectively. Each protrusion includes an opening therein for receiving a fastener. Upper and lower retainer clips 81 are secured to the upper and lower protrusions 78,79 by means of fasteners to secure the glass lens 76 in place.

It should be understood that, in the preferred embodiment, there is no silicon sealing strip between the glass lens 76 and the flange 72. Thus, the only means of retaining the glass lens 76 in place is by means of clips 81. As a result, the lens will not seal tightly against the flange. Flange 72 generally extends outwardly over the lens to prevent the passage of excessive amounts of water and moisture. However, it should be understood that moisture may get into the fixture from time to time. Such moisture will be channeled by groove 74 around to the bottom portion of the groove, from which it is allowed to exit between the flange 72 and the glass lens 76. Housing 50 also includes one or more openings 55 in the bottom wall 52 or in the lower rear wall (FIG. 11) to allow excessive moisture to escape.

The wire guard 80 is illustrated in FIGS. 3–6. Wire guard 80 is held in place by means of ears 84 which extend through slots 86 in the exterior wall of flange 72. To mount the wire guard, the sides thereof are pressed slightly inwardly and the frame guard is placed against the glass lens with the side members 87 thereof pushed inwardly. When the wire guard is released, the ears 84 expand to extend through the slots 86 in flange 72.

Figure 9:
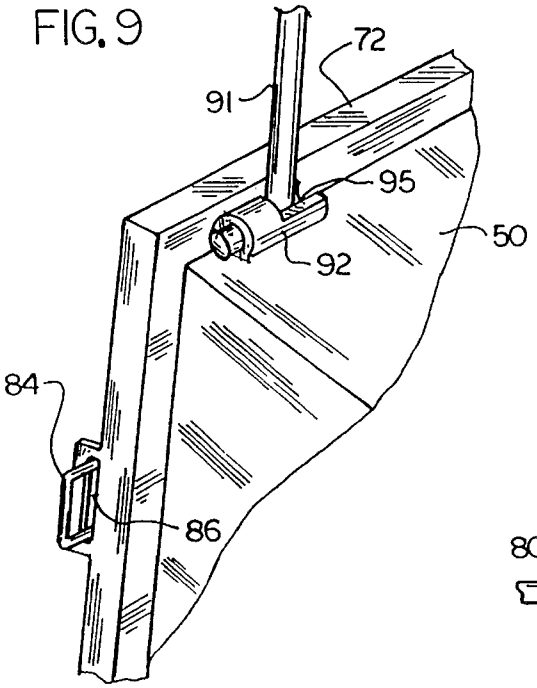
FIG. 9 is a perspective view similar to FIG. 7 except looking from the rear of the other upper corner.

Turning now to FIG. 9, there is illustrated the handle 90 and the manner in which it is retained in place. A unique slotted retainer 92 is formed in the upper surface of housing 50 immediately adjacent the rear of flange 72. The retainer 92 includes an opening therein through which the lower outer extensions of wire handle 90 extend. During shipment, the opposed legs 91,93 are pushed together and the wire handle 90 is rotated until it is flat against the upper wall of housing 50. When the fixture is assembled, the handle is merely rotated upwardly to its normal position, whereupon the legs 91,93 are urged outwardly into the locking slots 95 in the retainer 92. The handle is thus retained in its upright position unless and until it is desired to fold the handle downwardly again, whereupon the above procedure is reversed.

Figure 14:
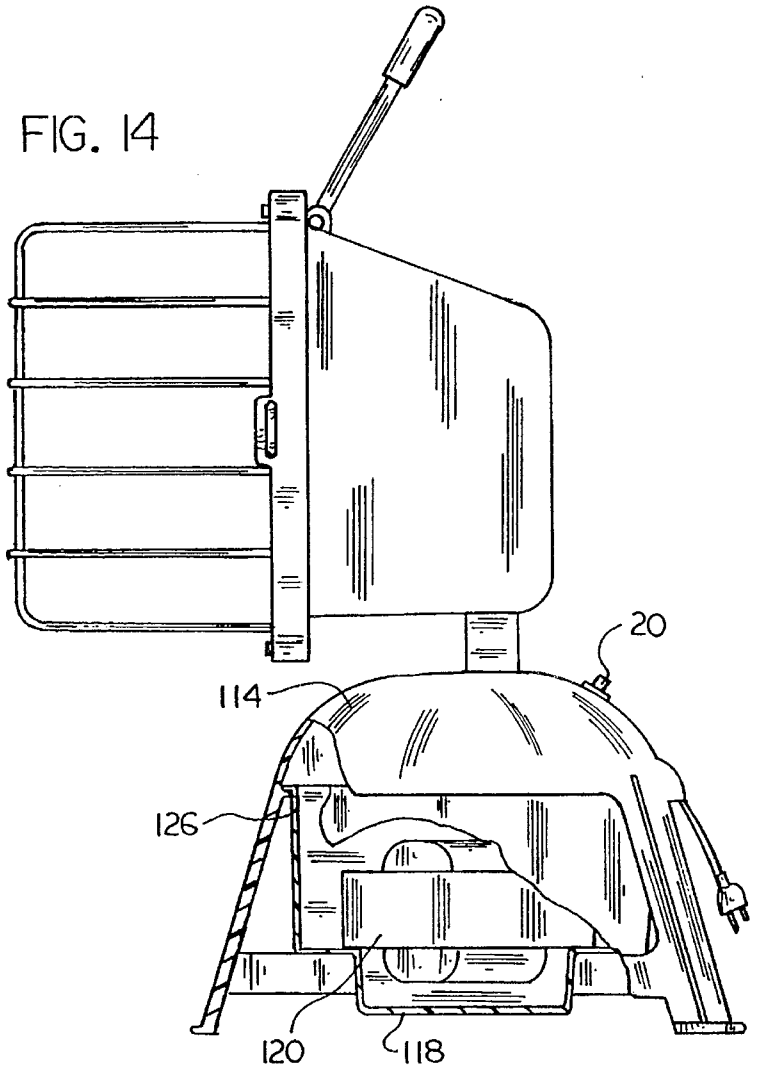
FIG. 14 is a side view, similar to FIG. 3, except showing an alternate embodiment for use with a high pressure sodium lamp, the stand and electrical component enclosure being shown in section.

Turning now to FIG. 14, there is illustrated an alternate embodiment of the fixture in which the lamp to be used is a high pressure sodium lamp. A ballast and ignitor are necessary. In the alternate embodiment illustrated in FIG. 14, the cover-plate 18 has been removed and replaced by an enclosure or container 118. The enclosure contains the ballast 120 and ignitor (not illustrated). The enclosure 118 is suitably secured to one or more of the aforementioned bosses 126 which extend downwardly from the domed portion 114. The container 118 then serves to protect the electrical elements from the weather, moisture, dirt, etc.

While preferred embodiments of the present invention have been described in detail hereinabove, it is apparent that various modifications might be made to the preferred embodiment without departing from the scope of the invention which is set forth in the claims below.

We claim:

1. A portable floodlight comprising:

a) a housing having an open front and containing a lamp mounted therein;

b) a support stand;

c) said support stand comprising a top portion forming a chamber thereunder and a plurality of legs extending downwardly therefrom, a support boss extending upwardly from said top portion and having an upper end;

d) said housing having a bottom wall and including an opening therein being mounted on the upper end of said support boss by a pivotal connection means; and e) wherein said support stand further includes a cover-plate mounted to said stand beneath said top portion and extending between said plurality of legs, said cover plate forming a protective chamber between said cover-plate and the underside of said top portion, a plurality of electrical connection terminals mounted within said protective chamber for connecting wiring from said lamp to an outside source of power.

2. The portable floodlight according to claim 1 wherein said plurality of legs comprises three spaced legs extending downwardly from said top portion.

3. The portable floodlight according to claim 1 wherein said pivotal connection means provides a friction engaging connection between said housing and the upper end of said boss.

4. The portable floodlight according to claim 3 wherein said pivotal connection means comprises a stem extending upwardly from said boss and through said opening, and a connector clip; said connector clip being resiliently attached to an upper end of said stem and causing said boss to frictionally engage said housing.

5. The portable floodlight according to claim 1 wherein said open front housing is covered by a glass lens, said housing including a flange surrounding said open front and having a recessed peripheral groove extending substantially the entire length of said flange, said lens being seated in said flange atop said groove and maintained against said flange by a metal clip.

6. The portable floodlight according to claim 5 wherein said peripheral groove channels water and moisture entering an upper portion thereof to a lower portion of said groove, from whence it is allowed to escape between the lens and the flange.

7. The portable floodlight according to claim 6 wherein drain holes are provided in a bottom portion of said housing.

8. The portable floodlight according to claim 1 wherein said housing includes an inverted U-shaped handle extending upwardly from an upper surface thereof.

9. A portable floodlight stand upon which a lamp housing for containing a lamp may be mounted comprising:

a) a top portion having an underside and forming a chamber thereunder;

b) a plurality of legs extending downwardly from said top portion of said stand;

c) a support boss extending upwardly from said top portion and having an upper end;

d) a pivotal connection means at the upper end of said boss for attaching a lamp housing thereto; and e) wherein said floodlight stand further includes a cover-plate mounted to said stand beneath said top portion and extending between said plurality of legs, said cover-plate forming a protective chamber between said cover-plate and the underside of said top portion, a plurality of electrical connection terminals mounted within said protective chamber for connecting wiring from the lamp to an outside source of power.

10. The portable floodlight stand according to claim 9 wherein said plurality of legs comprising three spaced legs extending downwardly from said top portion.

11. The portable floodlight stand according to claim 9 wherein said pivotal connection means provides a friction engaging connection between said housing and the upper end of said boss.

12. The portable floodlight stand according to claim 11 wherein said pivotal connection means comprises a stem extending upwardly from said boss and through an opening in said housing, and a connector clip; said connector clip being resiliently attached to an upper end of said stem and causing said boss to frictionally engage said housing.

13. In a portable floodlight of the type comprising an open front housing containing a lamp mounted therein, a lens covering said open front housing, a wire guard covering said lens, and a support stand to which said lamp housing is connected, the improvement whereby said support stand comprises a top portion forming a chamber thereunder, and a plurality of legs extending downwardly therefrom, a support boss extending upwardly from said top portion and having an upper end, and a pivotal connection means for mounting said housing onto the upper end of said boss, and wherein said support stand further includes a cover-plate mounted to said stand beneath said top portion and extending between said plurality of legs forming a protective chamber between said cover-plate and the underside of said top portion, a plurality of electrical connection terminals mounted within said protective chamber for connecting wiring from said lamp to an outside source of power.

14. The improvements in portable floodlights according to claim 13 wherein said plurality of legs comprises three spaced legs extending downwardly from said top portion.

15. The improvements in portable floodlights according to claim 13 wherein said pivotal connection means provides a friction engaging connection between said housing and the upper end of said boss.

16. The improvements in portable floodlights according to claim 13 wherein said pivotal connection means comprises a stem extending upwardly from said boss, a slot in a bottom wall of said housing through which said stem extends, and a connector clip; said connector clip being resiliently attached to an upper end of said stem and causing said boss to frictionally engage said housing.

17. The improvements in portable floodlights according to claim 13 further including a slot in said housing which includes a mechanical stop at either end thereof for limiting the pivotal movement of said housing.

18. The improvements in portable floodlights according to claim 13 wherein said open front housing has an open front covered by a glass lens, said housing including a flange surrounding said open front and having a groove therein, said lens being seated in said flange atop said groove and connected thereto by a metal clip.

19. The improvements in portable floodlights according to claim 18 wherein said peripheral groove channels water and moisture entering an upper portion thereof to a lower portion of said groove, from whence it is allowed to escape between the lens and the flange.

20. The improvements in portable floodlights according to claim 19 wherein said housing includes a bottom wall disposed below the lamp and drain holes are provided in said bottom wall of said housing.

21. The improvements in portable floodlights according to claim 13 wherein said housing includes an inverted U-shaped handle extending upwardly from an upper surface thereof above the lamp.

22. A lamp enclosure for portable floodlights of the type comprising a housing with rear, top, bottom and side walls and an open front, said enclosure further comprising said open front housing covered by a glass lens, said housing including an inverted U-shaped wire handle extending upwardly from the top wall thereof, a pair of spaced retainers formed into the top wall of said housing and each of said retainers including an opening therein through which a respective lower outer extension of said wire handle extends, each of said retainers including a locking slot in a wall thereof adjacent said opening, whereby, when the legs of said handle are urged outwardly into said locking slots, said wire handle assumes an operative position in which said wire handle is held upright, and, when said legs of said wire handle are removed from said slots, said wire handle assumes a shipping position wherein said handle may be rotated downwardly against the top wall of said housing.

23. A portable floodlight comprising:

a) a housing having an open front and containing a lamp mounted therein;

b) a support stand;

c) said support stand comprising a top portion forming a chamber thereunder and a plurality of legs extending downwardly therefrom, a support boss extending upwardly from said top portion and having an upper end;

d) said housing having a bottom wall and including an opening therein being mounted on the upper end of said support boss by a pivotal connection means; and e) wherein said pivotal connection means provides a friction engaging connection between said housing and the upper end of said boss, said pivotal connection means comprising a stem extending upwardly from said boss and through said opening, and a connector clip, said connector clip being resiliently attached to an upper end of said stem and causing said boss to frictionally engage said housing.

24. The portable floodlight according to claim 23 wherein said stem and boss include a central passageway through which wires pass connecting said lamp with electrical components in the chamber beneath said top portion.

25. The portable floodlight according to claim 23 wherein said opening in said housing includes a stop at either end thereof for limiting the pivotal movement of said housing.

26. The portable floodlight according to claim 23 further including a passageway in said boss and stem extending vertically with respect to said stem, said vertically extending passageway including two angular horizontal passageways at an upper end thereof for guiding the wires to the lamp in said housing and away from a reflector in said housing.

27. A portable floodlight stand upon which a lamp housing for containing a lamp may be mounted, the lamp housing including a bottom wall disposed below the lamp, comprising:

a) a top portion forming a chamber thereunder;

b) a plurality of legs extending downwardly from said top portion of said stand;

c) a support boss extending upwardly from said top portion and having an upper end; and d) a pivotal connection means at the upper end of said boss for attaching the lamp housing thereto; and e) wherein said pivotal connection means provides a friction engaging connection between said housing and the upper end of said boss, said pivotal connection means comprising a stem extending upwardly from said boss, a slot in said bottom wall of said housing through which said stem extends, and a connector clip; said connector clip being resiliently attached to an upper end of said stem and causing said boss to frictionally engage said housing.

28. The portable floodlight stand according to claim 27 wherein said stem and boss include a central passageway through which wires pass connecting the lamp with the electrical components in the chamber beneath said top portion.

29. In a portable floodlight of the type comprising an open front housing containing a lamp mounted therein an including a bottom wall disposed below the lamp, a lens covering said open front housing, a wire guard covering said lens, and a support stand to which said lamp housing is connected, the improvement whereby said support stand comprises a top portion forming a chamber thereunder, and a plurality of legs extending downwardly therefrom, a support boss extending upwardly from said top portion and having an upper end, and a pivotal connection means for mounting said housing onto the upper end of said boss, and wherein said pivotal connection means comprises a stem extending upwardly from said boss, a slot in said bottom wall of said housing through which said stem extends, and a connector clip; said connector clip being resiliently attached to an upper end of said stem and causing said boss to frictionally engage said housing.

30. The improvements in portable floodlights according to claim 29 wherein said stem and boss include a central passageway through which wires pass connecting said lamp with the electrical components in the chamber beneath said top portion.

31. The improvements in portable floodlights according to claim 29 wherein said slot in said housing includes a stop at either end thereof for limiting the pivotal movement of said housing, and further including a passageway in said boss and stem extending vertically with respect to said stem and including two angular, horizontal passageways at the upper end thereof for guiding the wires to the lamp in said housing and away from a reflector in said housing.

* * * * *